US005089853A

United States Patent [19]

Uematsu

[11] Patent Number: 5,089,853

[45] Date of Patent: Feb. 18, 1992

[54] ELECTROPHOTOGRAPHIC PRINTING APPARATUS WITH REPELLENT BANDS ON THE PHOTOCONDUCTIVE MEMBER AND THE DEVELOPING ROLLER TO PREVENT BUILDUP OF TONER THEREBETWEEN

[75] Inventor: Ryosuke Uematsu, Tokyo, Japan

[73] Assignee: NEC Corporation, Tokyo, Japan

[21] Appl. No.: 516,586

[22] Filed: Apr. 30, 1990

[30] Foreign Application Priority Data

Apr. 28, 1989 [JP] Japan ..... 1-109456

[51] Int. Cl.[5] ..... G03G 15/10

[52] U.S. Cl. ..... 355/256; 118/661; 430/117

[58] Field of Search ..... 355/245, 259, 256; 118/661, 644, 647, 651; 430/117, 118, 119, 102

[56] References Cited

U.S. PATENT DOCUMENTS 3,957,510 5/1976 Hermanson ..... 118/644 X
3,975,352 8/1976 Yoerger et al. ..... 430/117 X
4,241,694 12/1980 Cormier et al. ..... 118/661 X

FOREIGN PATENT DOCUMENTS 0128466 7/1985 Japan ..... 355/245
0231975 10/1987 Japan ..... 355/259
0098675 4/1988 Japan ..... 355/245

*Primary Examiner*—A. T. Grimley
*Assistant Examiner*—Christopher Horgan
*Attorney, Agent, or Firm*—Sughrue, Mion, Zinn, Macpeak & Seas

[57] ABSTRACT

An electrophotographic printing apparatus includes a liquid development unit for developing a latent electrostatic image formed on a photoconductive member with liquid developer. The liquid development unit has a developer roller whose surface faces the photoconductive member with a small gap spacing. A pair of spacer films are provided between the developer roller and photoconductive member at positions corresponding to axially end portions of the developer roller to determine the gap spacing. A pair of repellent band members are formed on the surfaces of the developer roller at positions between a developing area and the portion contacting the spacer film. A pair of repellent band members are also formed on the surface of the photoconductive member at positions corresponding to the repellent band member of the developer roller. The pairs of repellent band members prevent the accumulation of the liquid developer and further prevent the closing of the small gap spacing between the surface of the image forming area and developing area.

16 Claims, 2 Drawing Sheets

ELECTROPHOTOGRAPHIC PRINTING APPARATUS WITH REPELLENT BANDS ON THE PHOTOCONDUCTIVE MEMBER AND THE DEVELOPING ROLLER TO PREVENT BUILDUP OF TONER THEREBETWEEN

BACKGROUND OF THE INVENTION

The present invention relates to an electrophotographic printing apparatus equipped with a liquid development unit for developing a latent electrostatic image, formed on a surface of a photoconductive member, with liquid developer.

A conventional electrophotographic printing apparatus is disclosed in U.S. Pat. No. 4,268,597, which issued to Klavan et al. on May 19, 1981. The printing apparatus includes a liquid development unit which has a container for storing liquid developer and a developer roller rotatably provided and partially submerged in the liquid developer. The developer roller is located opposite a photoconductive member such that there is a small gap between opposing surfaces of the developer roller and photoconductive member.

In a developing operation, as the developer roller rotates, a film of the liquid developer is formed on the surface of the developer roller at a position close to the photoconductive member. The liquid developer film is partially attracted and then adheres to an electrostatic image which has been formed on the surface of the photoconductive member by electrostatic force.

In such a development unit, it is important to make the gap between the developer roller and photoconductive member small and constant in order to develop a fine electrostatic image. To this end, it is effective to provide a pair of spacer members between the developer roller and photoconductive member; the Klavan et al. patent discloses, in FIGS. 29 and 30, spacer annuli provided on both ends of the photoconductive member.

The conventional printing apparatus has, however, a disadvantage in that the liquid developer stagnates between the developer roller and the photoconductive member initially at the portions where the spacer members are provided due to the surface tension of the liquid developer. As a result, the gap tends to be stopped up with the liquid developer, causing the surface of the photoconductive member to be improperly developed. More specifically, the liquid developer adheres to the area of the photoconductive member's surface where the electrostatic image is not formed.

SUMMARY OF THE INVENTION

Therefore, an object of the present invention is to provide an electrophotographic printing apparatus capable of developing a latent electrostatic image with liquid developer, with high accuracy.

Another object of the present invention is to provide an electrophotographic printing apparatus capable of preventing the liquid developer from stopping up the spacing between a photoconductive member and a developer roller, even if spacer members are provided therebetween.

An electrophotographic printing apparatus according to the present invention comprises a photoconductive member including a surface having an image forming area and a non-image forming area means for forming an electrostatic image on the image forming area of the photoconductive member; a developer roller for developing the electrostatic image with a liquid developer, the developer roller including a surface facing the surface of the photoconductive member, the developer roller surface having a developing area facing said image forming area and a non-developing area facing the non-image forming area; a spacer member for determining a gap between the surface of the photoconductive member and the surface of the developer roller, the spacer member being in contact with both the non-image forming area of the photoconductive member and the non-developing area of the developer roller; and a repellent member provided on at least one of the surface of the photoconductive member, at a position between the image forming area and the portion in contact with the spacer member in the non-image forming area, and the surface of the developer roller, at a position between the developing area and the portion in contact with the spacer member in the non-developing area.

DETAILED DESCRIPTION OF THE PREFERRED EMBODIMENT

Figure 1:
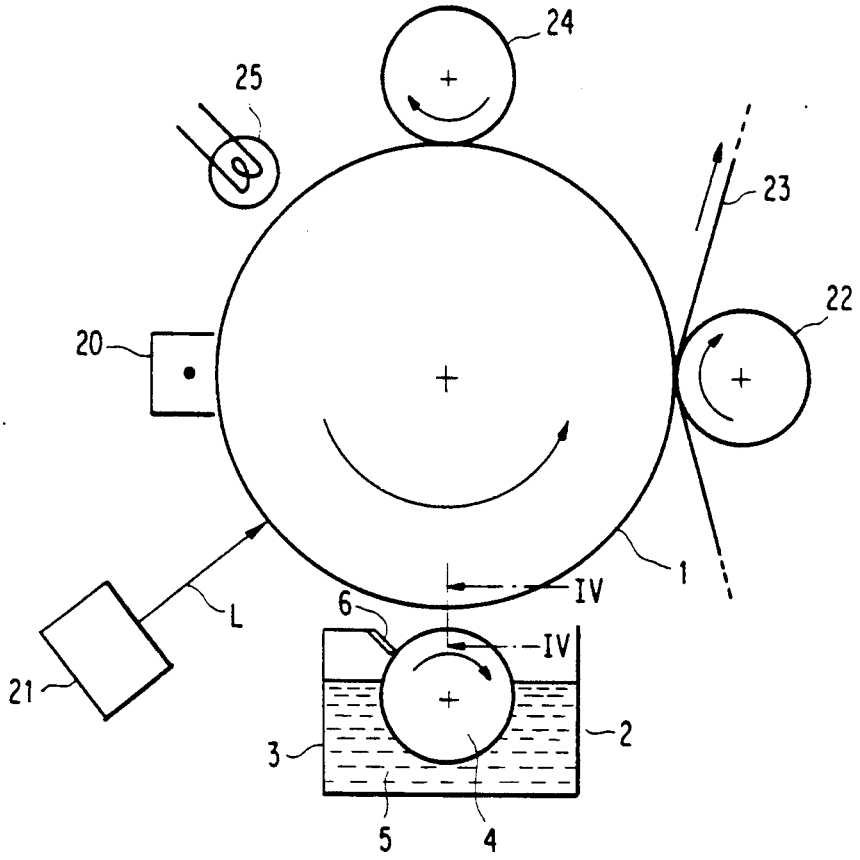
FIG. 1 shows schematically an embodiment of the present invention.

Referring to FIG. 1, an electrophotographic printing apparatus includes a photoconductive drum 1, as a photoconductive member which, as shown in FIG. 1, rotates in a counterclockwise direction around its rotational axis. In the order of the electrophotographic printing process, a charging unit 20, an exposure unit 21, a development unit 2, a transfer unit 22, a cleaning unit 24, and an erasing unit 25 are provided around the photoconductive drum 1, as is well known in the art.

The development unit 2 includes a container 3 for storing liquid developer (toner) 5 and a developer roller 4 located parallel to the photoconductive drum 1 and partially submerged in the liquid developer 5. The developer roller 4 rotates in a clockwise direction, as show in FIG. 1, around its axis. A doctor blade 6 is provided for scratching off excess liquid developer which adhered to a surface of the developer roller 4. With the rotation of the developer roller 4, a film of the liquid developer is formed on the surface of the developer roller 4 at a position opposite to the photoconductive drum 1. In this embodiment, a hollow sleeve is used as the developer roller 4.

In operation, the charging unit 20 uniformly charges a photoconductive surface of the drum 1. Next, the exposure unit 21 exposes a light beam L to the photoconductive surface of the drum 1 to form an electrostatic image which corresponds an image to be printed. Then the development unit 2 develops the electrostatic image with the liquid developer 5 which is attracted toward the photoconductive drum 1 by the electrostatic force of the electrostatic image, so that droplets of the liquid developer 5 adhere to the electrostatic image on the photoconductive drum surface. Thus, the electrostatic image becomes a visible image.

The transfer unit 22 transfers the visible image formed on the drum surface to a recording sheet 23, which is driven to a position between the photoconductive drum 1 and transfer unit 22. After that, the visible image transferred to the sheet 23 is fixed to the sheet 23 by applying heat and pressure, as is well known in the art. Then, the cleaning unit 24 cleans the untransferred liquid developer on the surface of the drum 1. Finally, the erasing unit 25 discharges the surface of the drum 1 so as to erase the electrostatic image formed thereon.

Figure 2:
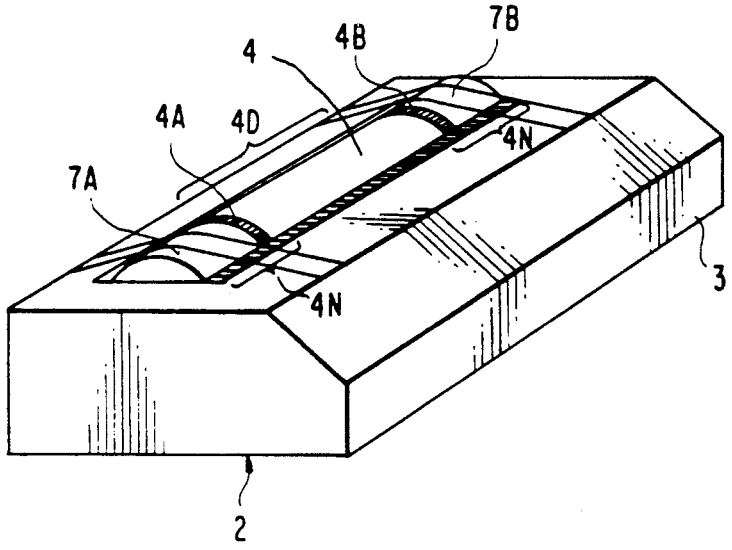
FIG. 2 is a perspective view showing a development unit used in the embodiment of the invention shown in FIG. 1.

Referring to FIG. 2, the development unit 2 has a pair of spacer films 7A and 7B, as spacer members, at both axially ends of the developer roller 4 for determining a spacing between the photoconductive drum 1 and the developer roller 4. Both ends of each of the spacer films 7A and 7B are fixed to an upper surface of the container 3 so that an intermediate portion of each of the spacer films 7A and 7B is in contact with the surface of the developer roller 4. The developer roller 4 has a cylindrical developing area 4D at its axially central portion, the developing area 4D facing a cylindrical image forming area 1D (FIG. 3) (used to form the electrostatic image) of the photoconductive drum 1. The area other than the developing area 4D is referred to as a non-developing area 4N.

A pair of repellent bands 4A and 4B are provided on a circumferential surface of the developer roller 4 at portions between the developing area 4D and each of the axially located end portions contacting the spacer films 7A and 7B. The repellent bands 4A and 4B are formed by coating the surface of the developer roller 4 with repellent material, such as fluorine resin.

Figure 3:
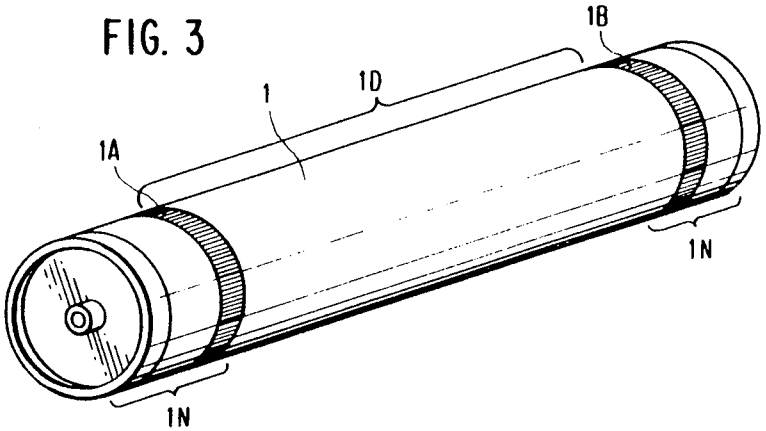
FIG. 3 is a perspective view showing a photoconductive drum used in the embodiment of the invention shown in FIG. 1.

Referring to FIG. 3, the photoconductive drum 1 also has a pair of repellent bands 1A and 1B provided on its circumferential surface at positions facing to the repellent bands 4A and 4B of the developer roller 4 when the development unit 2 and photoconductive drum 1 are installed as shown in FIG. 1. The repellent bands 1A and 1B are formed by coating the surface of the photoconductive drum 1 with repellent material, such as fluorine resin, similarly to the repellent bands 4A and 4B. As is apparent from FIG. 3, the image forming area 1D of the drum 1 is located between the repellent bands 1A and 1B. The area other than the image forming area 1D is referred to as a non-image forming area 1N.

Figure 4:
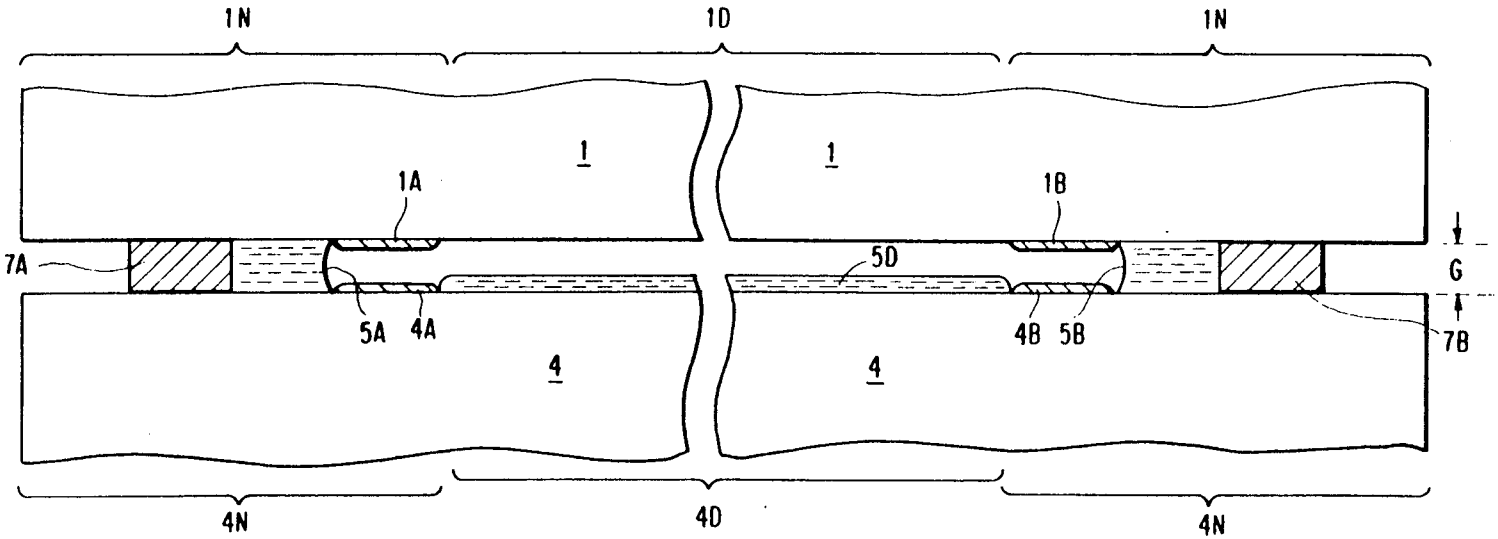
FIG. 4 is a cross-sectional view taken along a line IV—IV of FIG. 1 showing an operation of the embodiment of the invention.

Referring to FIG. 4, the photoconductive drum 1 and development unit 2 are assembled such that the surfaces of the drum 1 and developer roller 4 have a small gap G produced by means of the spacer films 7A and 7B. To stabilize the gap G, spring means (not shown) is provided to urge the drum 1 and roller 4 toward each other.

As the developer roller 4 rotates, the liquid developer film 5D is formed around the developer roller 4 so as to develop the electrostatic image formed on the image forming area 1D of the photoconductive drum 1 in the manner described in U.S. Pat. No. 4,268,597. In this developing operation, liquid developer 5A and 5B tend to stagnate between the surfaces of the drum 1 and roller 4 at the positions where the spacer films 7A and 7B are provided due to the surface tension of the developer 5A and 5B. The repellent bands 1A, 1B, 4A and 4B prevent the liquid developer 5A and 5B from growing and thereby stop up the gap spacing G between the surfaces of the image forming area 1D and developing area 4D. Therefore, the clearance between the surface of the image forming area 1A and the liquid developer film 5D is kept constant so that the liquid developer 5 adheres only to the portions where the electrostatic image is formed in the image forming area 1D.

In this embodiment, the repellent bands 1A, 1B, 4A and 4B are provided on both the developer roller 4 and photoconductive drum 1. However, similar advantage can be obtained even if repellent bands are provided on only the developer roller 4 or the photoconductive drum 1.

As described above, the present invention makes it possible to prevent the liquid developer from stopping up the gap between the photoconductive member and developer roller in the image forming area. As a result, high quality developing can be obtained.

What is claimed is:

1. An electrophotographic printing apparatus comprising:

a photoconductive member including a surface having an image forming area and a non-image forming area;

means for forming an electrostatic image on said image forming area of said photoconductive member;

a developer roller for developing said electrostatic image with a liquid developer, said developer roller including a surface facing said surface of said photoconductive member, said surface of said developer roller having a developing area facing said image forming area and a non-developing area facing said non-image forming area;

a spacer member for determining a gap between said surface of said photoconductive member and said surface of said developer roller, said spacer member being in contact with both said non-image forming area of said photoconductive member and said non-developing area of said developer roller; and a first repellent member provided on said surface of said developer roller at a position between said developing area and the portion contacting said spacer member in said non-developing area.

2. An electrophotographic printing apparatus as claimed in claim 1, further comprising a second repellent member provided on said surface of said photoconductive member at a position facing said first repellent member.

3. An electrophotographic printing apparatus as claimed in claim 1, wherein said first repellent member is a coating of fluorine resin on said surface of said developer roller.

4. An electrophotographic printing apparatus comprising:

a photoconductive member including a surface having an image forming area and a non-image forming area;

means for forming an electrostatic image on said image forming area of said photoconductive member;

a developer roller for developing said electrostatic image with a liquid developer said developer roller including a surface facing to said surface of said photoconductive member, said surface of said developer roller having a developing area facing said image forming area and a non-developing area facing said non-image forming area;

a spacer member for determining a gap between said surface of said photoconductive member and said surface of said developer roller, said spacer member being in contact with both said non-image forming area of said photoconductive member and said non-developing area of said developer roller; and a first repellent member provided on said surface of said photoconductive member at a position between said image forming area and the portion contacting said spacer member in said non-image forming area.

5. An electrophotographic printing apparatus as claimed in claim 4, further comprising a second repellent member provided on said surface of said developer roller at a position facing said first repellent member.

6. An electrophotographic printing apparatus as claimed in claim 4, wherein said first repellent member is a coating of fluorine resin formed on said surface of said photoconductive member.

7. A liquid development unit comprising:

a container for storing liquid developer;

a developer roller rotatably provided on said container and extending partially into said container, said developer roller including a cylindrical surface having a developing area in its axially central portion and non-developing areas at its axial end portions;

a pair of spacer films provided on said end portions so as to be in contact with said non-developing areas; and a pair of repellent bands circumferentially provided on said cylindrical surface of said developer roller at positions between said developing area and the portions contacting said spacer films in said non-developing area.

8. A liquid development unit as claimed in claim 7, wherein said repellent bands are coatings of fluorine resin formed on said cylindrical surface.

9. A developer roller for a development unit of an electrophotographic printing apparatus, comprising a cylindrical surface having a developing area in its axially central portion and non-developing areas at its axial end portions, each of said non-developing areas having a cylindrical contacting portion provided on the respective axial ends of said developer roller in contact with a spacer member, and a pair of repellent bands circumferentially provided on said cylindrical surface at positions between said developing area and said cylindrical contacting portions in the respective non-developing areas.

10. The developer roller as claimed in claim 9, wherein said repellent bands are coatings of fluorine resin.

11. A photoconductive member of an electrophotographic printing apparatus, comprising a surface having an image forming area and non-image forming areas at both end portions with respect to a direction perpendicular to a moving direction of said photoconductive member, each of said non-image forming areas having a contacting portion provided on the respective edges of said photoconductive member in contact with a spacer member, and a pair of repellent bands provided on said surface at positions between said image forming area and said contacting portions in said non-image forming areas.

12. The photoconductive member as claimed in claim 11, wherein said repellent bands are coatings of fluorine resin.

13. A method of forming a developer roller for a development unit of an electrophotographic printing apparatus, comprising the steps of: providing said roller with a substantially cylindrical outer surface having a developing area in its axially central portion and non-developing areas at its axial end portions, each of said non-developing areas having a cylindrical contacting portion provided on the respective axial ends of said developer roller in contact with a spacer member, and forming a pair of repellent bands on said cylindrical surface at positions between said developing area and said cylindrical contacting portions in said non-developing areas.

14. A method of forming a photoconductive member for an electrophotographic printing apparatus, comprising the steps of: providing a drum having a photoconductive outer surface, said outer surface having an image forming area and non-image forming areas at both end portions with respect to a direction perpendicular to a moving direction of said photoconductive member, each of said non-image forming areas having a contacting portion provided on the respective edges of said photoconductive member in contact with a spacer member, and forming a pair of repellent bands on said outer surface at positions between said image forming area and said contacting portions in said non-image forming areas.

15. The method of claim 13 wherein said step of forming a pair of repellent bands includes the step of coating said cylindrical surface with fluorine resin, at the locations for said repellent bands.

16. The method of claim 14 wherein said step of forming a pair of repellent bands includes the step of coating said outer surface with fluorine resin at the locations for said repellent bands.

* * * * *